United States Patent [19]

Hoeller

[11] 4,312,473

[45] Jan. 26, 1982

[54] TWO-CHAMBER ENVELOPE PACKAGE

[75] Inventor: Hans Hoeller, Bergisch Gladbach, Fed. Rep. of Germany

[73] Assignee: Robert Bosch GmbH, Stuttgart, Fed. Rep. of Germany

[21] Appl. No.: 129,283

[22] Filed: Mar. 11, 1980

[30] Foreign Application Priority Data

Mar. 23, 1979 [DE] Fed. Rep. of Germany ... 7908132[U]

[51] Int. Cl.[3] ..... B65D 25/08

[52] U.S. Cl. ..... 229/56; 206/219; 206/620; 229/48 T; 229/72; 426/115; 426/120

[58] Field of Search ..... 229/56, 48 T, 72; 206/219, 620, 631; 426/120, 119, 115

[56] References Cited

U.S. PATENT DOCUMENTS 2,401,110 5/1946 Rohdin ..... 229/56

2,916,197 12/1959 Detrie et al. ..... 229/56

*Primary Examiner*—George T. Hall

*Attorney, Agent, or Firm*—Edwin E. Greigg

[57] ABSTRACT

A two-chamber flat envelope for packaging various goods is proposed, the chambers of which can be opened uniformly for the purpose of filling. The envelope having two outer walls and a separating partition has plural seams at the edges of the walls joining these walls to one another. Furthermore the envelope has a first seam, which joins the partition to the first outer wall, and a second seam, which joins the partition to the other outer wall, each being located at a predetermined distance from one side seam.

4 Claims, 1 Drawing Figure

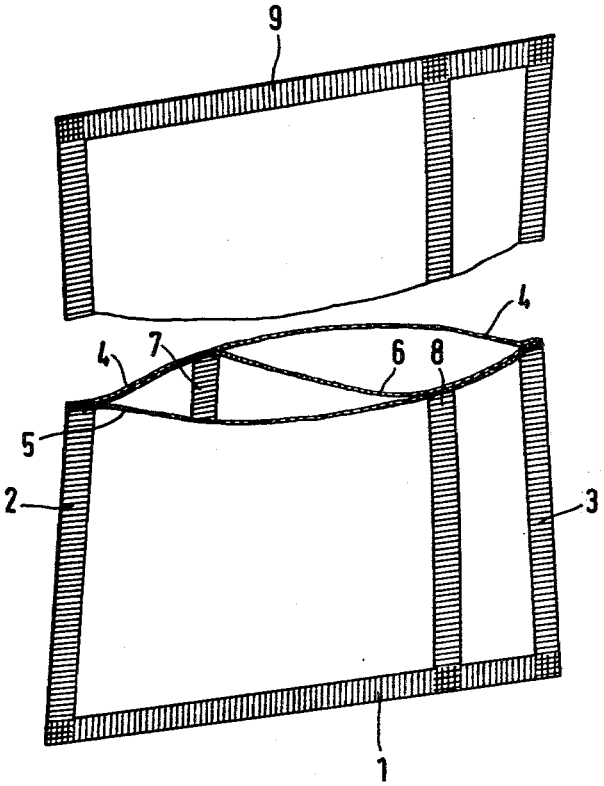
9
4
4
7
6
8
5
2
3
1

TWO-CHAMBER ENVELOPE PACKAGE

BACKGROUND OF THE INVENTION

The invention relates to a two-chamber flat envelope. In an envelope of this kind, known through U.S. Pat. No. 2,047,745, for instance, difficulties are associated with opening the envelope for the purpose of filling it, because when the outer walls are pulled apart, there is no assurance of a stable position for the partition between them. A two-chamber envelope is thus desired wherein both chambers are widened uniformly upon opening.

OBJECT AND SUMMARY OF THE INVENTION

The novel two-chamber flat envelope has the advantage over the prior art that the envelope can be opened on a packaging machine by simple suction means engaging the outer walls in such a manner that both chambers have the same opening cross section. Furthermore when the envelope is closed the distribution of material contained therein is more uniform; that is, the envelope does not bulge excessively at the middle.

The invention will be better understood and further objects and advantages thereof will become more apparent from the ensuing detailed description of a preferred embodiment taken in conjunction with the drawing.

BRIEF DESCRIPTION OF THE DRAWING

One exemplary embodiment of the invention is shown in schematic form in the drawing and described in detail below.

DESCRIPTION OF THE PREFERRED EMBODIMENT

Three sheets of equal size of a packaging material which is heat-sealable or weldable are placed one on top of the other and joined together by the application of pressure and heat, forming a bottom seam 1 at the bottom edge and two side seams 2, 3 at the side edges. Thus the two outermost sheets each form one outer wall 4, 5 and the middle sheet forms a partition 6 which separates the outer sheets. Parallel to the left-hand side seam 2 and at a distance of approximately one-third the width of the walls, there is a first seam 7 which joins the partition 6 to the first outer wall 4. In the same manner, a second seam 8 is disposed at the same distance from the right-hand side seam 3, joining the partition 6 to the other outer wall 5. The two seams 7, 8 function so as to permit the two chambers of the envelope, separated by the partition 6, to open uniformly for the purpose of filling when the outer walls 4, 5 are pulled open by suction means which engages them at the upper portion thereof. After the envelope is filled, it is sealed by means of a top seam 9 in the area of the upper edge of the walls 4, 5, 6.

The exemplary embodiment illustrated in the drawing and described above has two identically large chambers. However, should it be intended that two kinds of material, in differing quantities, be packaged therein, then the two chambers can also be of different sizes; this is accomplished by disposing the first seam at a distance from the associated edge of the envelope which is different from the distance at which the second seam is disposed from its associated edge.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A two-chamber flat envelope having first and second outer walls of equal length and a separating partition disposed therebetween and joined together therewith in the edge areas thereof, characterized in that the said partition is coextensive with said length of said outer walls and joined to said first outer wall by a first seam along its length at a predetermined distance from a first edge and joined to said second outer wall along its length by a second seam at a predetermined distance from a second edge located opposite said first edge.

2. An envelope as defined by claim 1, characterized in that the distance from each first and second seams to its associated edge is approximately one-third the width of the envelope.

3. An envelope as defined by claim 1, wherein said first and second outer walls and said partition are made of equal sized heat-sealable packaging material, characterized in that said first and second seams are formed by means of heat sealing.

4. An envelope as defined by claim 2, wherein said first and second outer walls and said partition are made of equal sized heat-sealable packaging material, characterized in that said first and second seams are formed by means of heat sealing.

* * * * *